US006752217B2

(12) United States Patent
Reilly

(10) Patent No.: US 6,752,217 B2
(45) Date of Patent: Jun. 22, 2004

(54) DRY ACCELERATOR FOR SPRINKLER SYSTEM

(75) Inventor: William J. Reilly, Langhorne, PA (US)

(73) Assignee: Victaulic Company of America, Easton, PA (US)

( * ) Notice: Subject to any disclaimer, the term of this patent is extended or adjusted under 35 U.S.C. 154(b) by 112 days.

(21) Appl. No.: 10/242,791

(22) Filed: Sep. 12, 2002

(65) Prior Publication Data

US 2003/0047325 A1 Mar. 13, 2003

Related U.S. Application Data

(63) Continuation-in-part of application No. 09/526,250, filed on Mar. 16, 2000.

(60) Provisional application No. 60/361,777, filed on Mar. 5, 2002.

(51) Int. Cl.[7] ..... A62C 35/00; A62C 37/36

(52) U.S. Cl. ..... 169/17; 169/16; 169/18; 169/22; 169/42

(58) Field of Search ..... 169/16, 17, 18, 169/19, 20, 42, 9, 22; 239/533.1, 569, 570, 572; 251/28, 30.05, 30.02, 61.2; 137/516.29, 527.8, 516.25

(56) References Cited

U.S. PATENT DOCUMENTS

| | | | | |
|---|---|---|---|---|
| 2,187,906 A | | 1/1940 | Lowe | |
| 2,695,609 A | | 11/1954 | Nourse et al. | |
| 2,731,091 A | | 1/1956 | Robbins | |
| 2,822,052 A | | 2/1958 | Herkimer | |
| 3,165,115 A | | 1/1965 | Erson | |
| 3,589,445 A | | 6/1971 | Juliano | |
| 3,595,318 A | | 7/1971 | Merdinyan | |
| 3,727,878 A | | 4/1973 | Willms | |
| 3,785,440 A | | 1/1974 | Shea | |
| 4,286,668 A | | 9/1981 | McCormick | |
| 4,570,719 A | | 2/1986 | Wilk | |
| 4,615,353 A | | 10/1986 | McKee | |
| 4,854,342 A | | 8/1989 | Polan | |
| 5,096,266 A | | 3/1992 | Skantar | |
| 5,294,090 A | | 3/1994 | Winnike | |
| 5,439,028 A | | 8/1995 | Meyer et al. | |
| 5,843,345 A | * | 12/1998 | Guntly | 261/34.2 |
| 5,899,277 A | | 5/1999 | Eisenbeiss et al. | |
| 6,000,473 A | | 12/1999 | Reilly | |
| 6,029,749 A | | 2/2000 | Reilly et al. | |
| 6,068,057 A | | 5/2000 | Beukema | |
| 6,138,766 A | | 10/2000 | Finnerty et al. | |
| 6,158,520 A | | 12/2000 | Reilly et al. | |
| 6,293,348 B1 | * | 9/2001 | Reilly | 169/16 |
| 6,378,616 B2 | * | 4/2002 | Reilly | 169/17 |
| 6,536,533 B2 | * | 3/2003 | Reilly | 169/16 |

FOREIGN PATENT DOCUMENTS

| | | | |
|---|---|---|---|
| DE | 39 40 446 | 6/1990 | A47B/46/00 |
| FR | 2 334 032 | 7/1977 | F16K/17/36 |
| WO | WO 99/59678 | 11/1999 | A62C/37/06 |

OTHER PUBLICATIONS

U.S. patent application Ser. No. 09/526,250, filed Mar. 16, 2002, entitled "Dry Accelerator for Sprinkler System" (Reilly).

* cited by examiner

*Primary Examiner*—Davis Hwu
(74) *Attorney, Agent, or Firm*—Synnestvedt & Lechner LLP

(57) ABSTRACT

An accelerator for venting a pressurized gas source to the ambient is disclosed. The accelerator includes a first gas compartment connected to the pressurized gas source. A second gas compartment is connected to the first gas compartment through a one-way valve allowing gas to pass from the first gas compartment to the second gas compartment. A restrictor orifice allows gas to pass between the first and the second gas compartments at a predetermined rate. A valve member in the first gas compartment is normally in the closed position and moves to the open position in response to a pressure drop of the pressurized gas source causing a pressure differential between the first and second gas compartments, thereby venting the pressurized gas source to the ambient through the valve member in the first gas compartment.

11 Claims, 2 Drawing Sheets

DRY ACCELERATOR FOR SPRINKLER SYSTEM

RELATED APPLICATIONS

This application is a continuation-in-part which claims priority to U.S. application Ser. No. 09/526,250, filed Mar. 16, 2000 and U.S. Provisional Application No. 60/361,777, filed Mar. 5, 2002.

FIELD OF THE INVENTION

The present invention relates to an accelerator for use in a dry, pressurized-gas, liquid extinguent sprinkler fire control and suppression system. The dry accelerator of the present invention is applicable for use in a dry type fire control and suppression sprinkler system, in which the piping between the source of the pressurized liquid extinguent, typically water, and individual sprinkler heads is normally pressurized with a gas, typically air, and is void of liquid until the system becomes actuated. The dry accelerator of the present invention is utilizable for all dry type sprinkler systems regardless of system operating gas pressure.

BACKGROUND OF THE INVENTION

Fire control and suppression sprinkler systems generally include a plurality of individual sprinkler heads which are usually ceiling mounted about the area to be protected. The sprinkler heads are normally maintained in a closed condition and include a thermally responsive sensing member to determine when a fire condition has occurred. Upon actuation of the thermally responsive member, the sprinkler head is opened, permitting pressurized water at each of the individual sprinkler heads to freely flow therethrough for extinguishing the fire. The individual sprinkler heads are spaced apart from each other by distances determined by the type of protection they are intended to provide (e.g., light or ordinary hazard conditions) and the ratings of the individual sprinklers, as determined by industry accepted rating agencies such as Underwriters Laboratories, Inc., Factory Mutual Research Corp. and/or the National Fire Protection Association. It should be well appreciated that once the sprinkler heads have been thermally activated there should be minimal delay for the water flow through the sprinkler head at its maximum intended volume.

In order to minimize the delay between thermal actuation and proper dispensing of water by the sprinkler head, the piping that connects the sprinkler heads to the water source is, in many instances, at all times filled with water. This is known as a wet system, with the water being immediately available at the sprinkler head upon its thermal actuation. However, there are many situations in which the sprinkler system is installed in an unheated area, such as warehouses. In those situations, if a wet system is used, and in particular, since the water is not flowing within the piping system over long periods of time, there is a danger of the water within the pipes freezing. This will not only deleteriously affect the operation of the sprinkler system should the sprinkler heads be thermally actuated while there may be ice blockage within the pipes but, such freezing, if extensive, can result in the bursting of the pipes, thereby destroying the sprinkler system. Accordingly, in those situations, it is the conventional practice to have the piping devoid of any water during its non-activated condition. This is known as a dry fire protection system.

While all fire protection sprinkler systems generally include a check valve for isolating the sprinkler system piping from the pressurized water source during the non-activated condition, the design of such check valves for a dry type fire control sprinkler system has presented various problems. The check valve, which is interposed between the system piping and pressurized water source, includes a clapper which, when it is in its closed operative condition, prevents the flow of the pressurized water into the sprinkler system piping. The sprinkler piping in the dry fire protection system normally contains air or some other inert gas-(e.g., nitrogen) under pressure. The pressurized air, which is also present within the sprinkler system piping, is presented to the check valve. Should one or more of the sprinkler heads be thermally activated to its open condition, the pressure of the air within the sprinkler system piping and check valve will then drop. The check valve must be appropriately responsive to this drop in pressure, normally in opposition to the system water pressure also present in the check valve, to move the clapper to its open condition. When this occurs, it is desirable to have a rapid expulsion of the pressurized air within the check valve and the sprinkler system piping to permit the rapid flow of the pressurized water through the open check valve into the sprinkler system piping and through the individual sprinkler heads to rapidly extinguish the fire.

The check valves intended for dry-type fire control sprinkler systems have typically controlled the clapper movement by the water and the air pressure applied to its opposite sides. Such fire check valves include an air seal which opposes the pressurized water seal. To appropriately apply the system air pressure over the surface of the clapper air seal, a priming water level is oftentimes maintained within the check valve. During normal conditions, when no sprinkler heads have been activated, the two seals will be at an equilibrium, thereby maintaining the clapper in its closed condition.

In order to increase the speed of check valve operation upon a drop off of the system air pressure, occasioned by the activation of one or more sprinkler heads, the system air pressure is normally applied to the clapper air seal over a substantially greater area than the water pressure is applied to the clapper water seal. This is known as a high differential type check valve. A problem of such valves is that should there be a reduction in the system water pressure after the clapper has opened, there is a tendency for the clapper to re-close, particularly since the pressure against the opposite (air) side of the clapper has thereby been increased due to the column of water that has flowed therethrough. Since the pressure applied against the air seal of the clapper will now be increased by the column of water extending upwards from the re-closed check valve, a greater water pressure would now be required to move the clapper to its open condition. Such disadvantageous re-closure is referred to as a water columning effect. This could result in failure of the check valve to subsequently open should one or more of the sprinkler heads be thermally activated.

In order to avoid the re-closure of the clapper, prior art dry system check valves have generally been provided with a mechanical latch to maintain the clapper in its open condition once it has been activated. The inclusion of such a mechanical latch, while serving to prevent re-closure, however, disadvantageously requires the entire sprinkler system to be shut down and the interior of the high differential type actuator accessed to release the latch and re-close the clapper after the fire has been extinguished. Thus prior dry system check valves have typically required the main supply of water to be shut off, the water drained from the system and then the high differential check valve opened to manually unlatch and reset the clapper. Recognizing the disadvantage of having to manually access the interior of the check valve, a mechanism is shown in U.S. Pat. Nos. 5,295,503 and 5,439,028, which include a reset linkage mechanism that is attached to the check valve and is actuated by the rotation of an externally accessible handle. As can be well appreciated such a mechanism adds to the size, cost and complexity of the check valve.

Traditionally, dry pipe valves used in sprinkler systems employ pressurized air in order to keep water from entering the sprinkler system. Although this pressurized air is given a mechanical advantage over the water pressure, typically of from about 5–8:1, typical air pressures in dry sprinkler systems are from 30 psi to 50 psi. Displacement of this volume of air from the piping of the sprinkler system will delay the operation of the sprinkler control valve, as well as slow the rate of water entry into the sprinkler system once the control valve is actuated.

Traditional accelerators operate by sensing a rapid decay of sprinkler system air pressure, caused by sprinkler head activation. Upon the detection of the pressure loss, the accelerator will divert system air pressure into the middle chamber of the dry valve the accelerator is attached to. As the sprinkler system air enters the dry valve mid chamber, the pressure differential in the dry valve is removed and the dry valve will activate allowing water to enter the sprinkler system.

In a less traditional dry valve, the accelerator, sensing a rapid pressure decay in the sprinkler system, opens a water port. When the water port opens, water is allowed to flow from the valve piston. This allows the piston to retract from the valve body, which in turn allows the actuated valve clapper to open and water to flow into the sprinkler system.

SUMMARY OF THE INVENTION

A dry accelerator according to the present invention for use in a dry, pressurized-gas, liquid sprinkler fire control and suppression system is response-sensitive to a sudden, rapid decay in gas pressure in the system, caused by a system-triggering event. The dry accelerator functions to accelerate the actuation of at least one other device in the system that controls the release of a fire-extinguishing liquid or liquid fire-extinguent.

Generally, a dry accelerator according to the present invention comprises a housing with two gas chambers therein, separated by a diaphragm, such that a first one of the gas chambers has a first operative condition wherein it is closed to an ambient external pressure, and a second operative condition wherein it is open to an ambient external pressure. When the first gas chamber is in its first operative condition, there is an equal gas pressure in the first and second gas chambers and when the first gas chamber is in the second operative condition, which operative condition is actuated by a sudden drop in system gas pressure caused by a system-triggering event, such as the opening of one of the remote sprinkler heads due to the detection by the head of a thermally triggering event. A pressure differential is then established between the first chamber and the second chamber, as the pressure in the first chamber falls to the rapidly declining system pressure. The system pressure will decline to the ambient pressure as pressurized gas in the system begins to flow out of the system via the thermally-actuated, opened sprinkler head. The dry accelerator further has a spring that is biased to exert a force on a piston which maintains a gas-tight seal of the first chamber when the first and second chambers are in their first operative condition and the gas pressures therein are equal. The spring force on the piston is sufficient to maintain the diaphragm in a first, sealing position between the first gas chamber and the second gas chamber, when the first gas chamber is in its first operative condition, such that the diaphragm acts to maintain equal gas pressure in the first and second gas chambers. When the first gas chamber is in its second operative condition, there is a greater pressure in the second gas chamber than in the first gas chamber, the pressure then also being greater than the force exerted by the spring on the piston to maintain the diaphragm in its first sealing position, such that the diaphragm is moved to a second, open position in which it exerts a counter-force on the piston sufficient to cause the first gas chamber to assume its second operative condition, wherein it is open to external ambient pressure. In this condition, any remaining gas in the first chamber is caused to be evacuated, as the system gas pressure continues to further decline to the ambient, open system pressure. The ambient, open system pressure is typically the prevailing surrounding atmospheric pressure, typically about 14.7 psi. At this time, another device in the system, typically a check valve, that directly controls release of a liquid fire-extinguent to a plurality of sprinkler heads of the system is caused to be actuated to allow the liquid fire extinguent, which is typically water, and which may further contain one or more fire-retarding chemicals, to flow to the plurality of sprinkler heads.

The advantage of the presence of the dry accelerator in the system is that the residual gas pressure in the system, remaining after a decline from an initial system gas pressure that has been caused to suddenly and rapidly decline due to the system triggering event, at which the check valve is actuated is higher than would be required to actuate the check valve or other device in the system if the dry accelerator were not present. Without the presence of the accelerator, the system pressure would have to decline to a lower pressure before the check valve was triggered if there were no dry accelerator present in the system. The dry accelerator of the present invention is response-sensitive to a fall in system pressure from an initial system pressure of less than about 5 psi from the initial system pressure. The dry accelerator of the present invention, moreover, is utilizable in all types of systems, both those which operate at higher gas pressure, of the order of from about 15 psi to about 60 psi initial system gas pressure, and those which operate at low gas pressure, of the order of from about 5 psi to about 20 psi initial system gas pressure.

The dry accelerator of the present invention, for use in a dry, pressurized-gas, water sprinkler fire control and suppression system generally includes a housing having an upper chamber and a lower chamber spaced along a vertical axis, in communication with one another, with the upper chamber further having an upper gas compartment for containing a volume of gas and the lower chamber having a lower gas compartment for containing a volume of gas. The upper gas compartment has a gas orifice therein, the upper gas compartment being in fluid contact with a valve actuating device and the sprinkler system. The dry accelerator further has an accelerator shaft, within the upper gas compartment, with an orifice therein being in communication with the gas orifice; a diaphragm, positioned at a base of the accelerator shaft, having a diaphragm orifice therein for the passage of gas therethrough, the diaphragm being moveable and flexible alternatively between a first position wherein the diaphragm forms a fluid-tight seal between the upper gas compartment and the lower gas compartment, and a second position wherein the seal between the upper gas compartment and the lower gas compartment is open; a piston, slideably moveable in the accelerator shaft; a restrictor for equalizing the pressure in the upper and lower gas compartments; and a spring, biased to maintaining the piston in a closed position. When the air pressure in the lower chamber exceeds the spring force, the piston is urged upward, thereby breaking the upper seal and causing air to be evacuated from the control valve actuator. The responsiveness of the accelerator can be adjusted by turning an adjusting nut to vary the amount of compression of the spring, and thus, the force exerted on the piston when in a closed position.

The dry accelerator of the present invention, particularly a Series 746 dry accelerator, works in conjunction with either a Series 753A dry actuator or a Series 776 Low Pressure actuator, as are manufactured and sold by Victaulic Fire Safety Company LLC, Easton, Pa., USA. The dry accelerator of the present invention senses a rapid pressure loss in the sprinkler system. When this rapid pressure loss is detected, the dry accelerator of the present invention opens an air port to atmosphere. This allows the air in the upper chambers of the dry accelerator to be rapidly exhausted to atmosphere. With the loss of air pressure in the dry accelerator, other devices in the system, particularly the check valve, are actuated and are caused to operate in their normal manner, thereby opening the water line from the actuated valve piston to atmosphere. The actuated valve is then activated in its intended manner allowing water to enter the sprinkler system.

The invention comprises an accelerator for venting a pressurized gas source to the ambient. The accelerator comprises a first gas compartment having an inlet orifice connectable to the pressurized gas source and an outlet providing fluid communication with the ambient. A second gas compartment is positioned adjacent to the first gas compartment and has a closable opening providing fluid communication with the ambient. A flexible diaphragm is positioned between the first and the second gas compartments, the diaphragm being deflectable in response to relative gas pressure within the compartments. A one-way valve positioned in the diaphragm allows gas to pass from the first gas compartment to the second gas compartment. A restrictor orifice is positioned in the diaphragm allowing gas to pass between the first and the second gas compartments at a predetermined rate. A valve member is attached to the diaphragm and extends to a position engaging the outlet. The valve member is movable upon deflection of the diaphragm between a closed position, closing the outlet, and an open position opening the outlet to the ambient. The valve member is normally in the closed position and moves to the open position upon deflection of the diaphragm toward the first gas compartment in response to a pressure drop of the pressurized gas source of a predetermined magnitude, thereby venting the pressurized gas source to the ambient through the outlet.

Preferably, the accelerator further comprises a spring engaging and biasing the valve member into the closed position with a predetermined biasing force.

The invention further contemplates a fire suppression sprinkler system having piping connected to a plurality of sprinkler heads in fluid communication with a source of pressurized water through a control valve actuated by an actuator connected with a pressurized gas source. The system has an accelerator as described above and operatively associated with the actuator and connected with the pressurized gas source. The accelerator causes the actuator to open the control valve in response to a decrease in pressure of the pressurized gas source.

It is, therefore, a primary object of the present invention to provide an improved dry accelerator, having particularly utilization in conjunction with dry fire control and suppression sprinkler systems.

Another object of the present invention is to provide a dry accelerator which operates in response to a drop in system air pressure, and provides for rapid evacuation of gas within the dry accelerator to enhance its speed of operation.

Still another object of the present invention is to provide a dry accelerator for use in dry fire control and suppression sprinkler systems, wherein the time for system gas pressure to vent and extinguishing liquid to flow to sprinkler heads of the system is greatly reduced.

A still further object of the present invention is to provide a dry accelerator for use in dry fire control and suppression sprinkler systems, wherein an actuator is more rapidly actuated so as to rapidly actuate the check valve in the system.

An additional object of the present invention is to provide a dry accelerator for use in dry fire control and suppression sprinkler systems, wherein the dry accelerator is responsive to a rapid decline in system gas pressure.

Yet another additional object of the present invention is to provide a dry accelerator for use in dry fire control and suppression systems utilizing a low-differential check valve.

Yet another additional object of the present invention is to provide a dry accelerator which provides a fast response to the check valve and prevents air and water buildup in an actuator-accelerator.

These as well as other objects of the present invention will become apparent upon a consideration of the following detailed description and drawings.

DETAILED DESCRIPTION OF THE PREFERRED EMBODIMENT OF THE INVENTION

Figure 1:
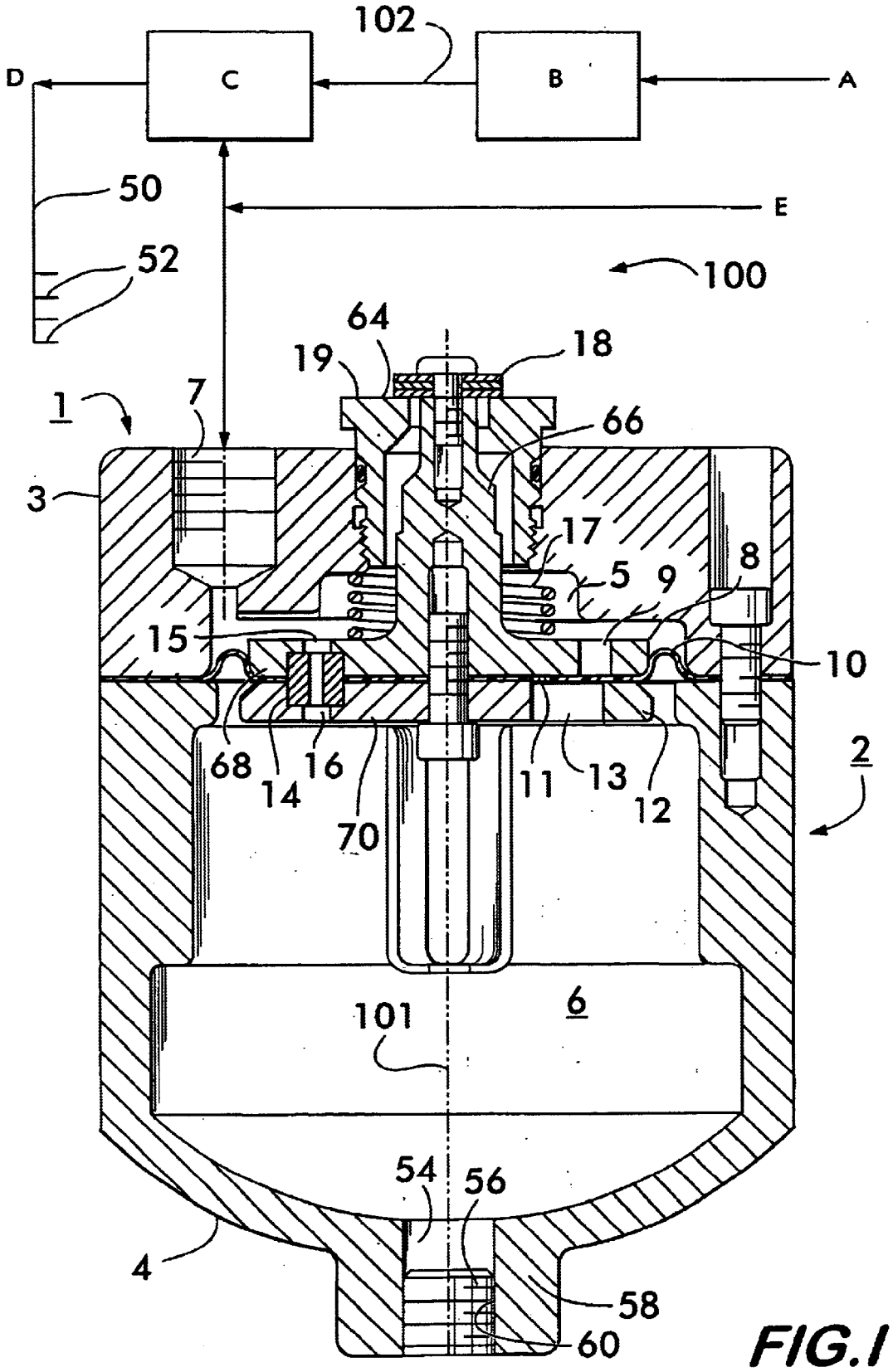
FIG. 1 is a cross-sectional view of a dry accelerator for a dry sprinkler system according to the present invention, shown in the closed position.

Referring now initially to FIG. 1, a particularly preferred embodiment of a dry accelerator 1 of the present invention for use in a dry sprinkler system 100, such as is made and sold by Victaulic Fire Safety Company LLC, Easton, Pa., U.S.A., as the Series 746 Dry Accelerator, is installed in a dry fire control and suppression sprinkler system so as to be in fluid communication with both an actuator or low pressure actuator (C), such as a Series 753A or Series 776 Low Pressure Actuator, as manufactured by Victaulic Company of America, Easton, Pa., U.S.A., and a check valve (B), which provides a fire extinguishing liquid from a pressurized source (A) to the piping 50 and a plurality of individual sprinkler heads 52 comprising sprinkler system 100.

The system 100, including the actuator-accelerator C, and the dry accelerator 1 of the present invention, is first readied for operation by placing the dry accelerator 1 in a closed, set, ready-for-use condition. The dry accelerator 1 is set by first introducing a gas, usually air, into the sprinkler system piping 50, actuator-accelerator C, and the dry accelerator 1 itself.

The dry accelerator 1 includes a housing 2, which has a vertical axis 101, and itself includes two chambers, namely, an upper chamber 3, and a lower chamber 4, which are spaced along the vertical axis. The housing is constructed of a high strength metallic material, typically brass. However, it should be understood that other materials and processes of manufacture can be used. For instance the housing 2 could be constructed of machined stainless steel or suitably molded plastic or other materials having the requisite strength.

The upper chamber 3 and the lower chamber 4 are in communication with each other. The communication between the upper chamber 3 and the lower chamber 4 is made fluid-tight by extending the diaphragm 10 fully to the ends of the upper and lower chambers, or, alternatively, by the provision of at least one sealing gasket or device, such as an O-ring (not shown), at the juncture of respective side ends of the upper and lower chambers.

The upper chamber 3 has an upper gas compartment 5 therein, for the accumulation of a volume of gas. The lower chamber 4 has a lower gas compartment 6 therein for the accumulation of a volume of gas. The upper gas compartment 5 and the lower gas compartment 6 are in fluid communication with each other. The upper gas compartment 5 is also in fluid communication with a valve actuating device, such as the Series 753A or Series 776 Victaulic actuators (C), as well as with the sprinkler system itself.

Pressurized gas from an external source E enters the system through a sprinkler control valve trim (not shown) and then into the upper gas compartment 5 of the dry accelerator 1, through restricted gas orifice 7. The gas then passes through accelerator shaft orifice 9 in accelerator shaft 8, located in upper gas compartment 5, where the gas impinges on the diaphragm 10, causing the diaphragm 10 to deflect away from a bottom of the accelerator shaft 8. The diaphragm 10 has a diaphragm orifice 11 extending through the diaphragm, through which the gas passes on its way through a piston 12, the piston having a bottom portion comprising a retainer plate 70 located below the diaphragm 10, and an upper portion 66 located above the diaphragm, the upper portion 66 having a flange 68 interfacing with the diaphragm. The diaphragm 10 is captured between the retainer plate 70 and the upper piston portion 66. The diaphragm 10 is fabricated from a flexible material, and is preferably formed of rubber. The gas then passes through piston orifice 13 in the piston 12, and finally into the lower gas compartment 6.

At the time of initialization of the dry accelerator 1, the gas pressure in the upper gas compartment 5 and the lower gas compartment 6 is the same. In this condition, the diaphragm 10 is in a flat, un-deflected condition, at the bottom of the accelerator shaft 8. In this condition, a reverse flow of gas from the lower gas compartment 6 through accelerator shaft orifice 9 to upper gas compartment 5 is prevented by the diaphragm 10 covering the orifices 9 and 13. Note that accelerator orifice 9 is located in the flange 68, and is positioned so as to be covered by diaphragm 10 when it is in the flat, undeflected position. Diaphragm 10 has a diaphragm orifice 11 in a position offset from the accelerator orifice 9. Piston orifice 13 extends through the retainer plate 70, the piston orifice 13 being sized and positioned so as to overlie both the diaphragm orifice 10 and the accelerator orifice 9. Relatively higher gas pressure within the upper gas compartment 5 acting through the accelerator orifice 9 deflects the diaphragm 10 into the piston orifice 13 thereby uncovering the accelerator orifice and allowing gas to pass from the upper gas compartment 5 through the accelerator orifice 9, the diaphragm orifice 11 and the piston orifice 13 and into lower gas compartment 6. Relatively higher gas pressure in the lower gas compartment 6 acting through the piston orifice 13 and forcing the diaphragm 10 against the flange 68 and thereby covering the accelerator orifice 9 and preventing gas from passing from the lower gas compartment 6 to the upper gas compartment 5. In allowing gas to pass from upper gas compartment 5 through the accelerator orifice 9, through the diaphragm orifice 11 and piston orifice 13, but not in the reverse direction, these components act as a one way valve in the diaphragm to allow gas flow from the upper gas compartment 5 to the lower gas compartment 6 but not back.

Coiled mechanical spring 17, which surrounds the upper portion 66 of piston 12, is in a relaxed state during this initialized condition of the dry accelerator, and it provides a closing force on the piston 12 to close off the accelerator shaft 8, by urging the upper seal 18 into a closed position abutting against adjusting nut 19. The upper piston portion 66 and the upper seal 18 act as a valve closing member which is engaged and biased by spring 17. The pressure in the lower gas compartment 6 can be relieved through the restrictor 14, which has a first opening 15 on the upper gas chamber side, and a second opening 16 on the lower gas chamber side. Restrictor 14 allows the pressure in the lower gas compartment 6 to remain equal to the pressure in the upper gas compartment 5, during relatively minor sprinkler gas pressure perturbations. This same gas pressure also acts on the valve actuating device. The pressure in the lower gas compartment may also be relieve by the removal of a removable plug 56 which is positioned within a nipple 58 having screw threads 60 for retaining the plug 56. The plug may be removed, for example, to reset the accelerator after it has tripped.

Figure 2:
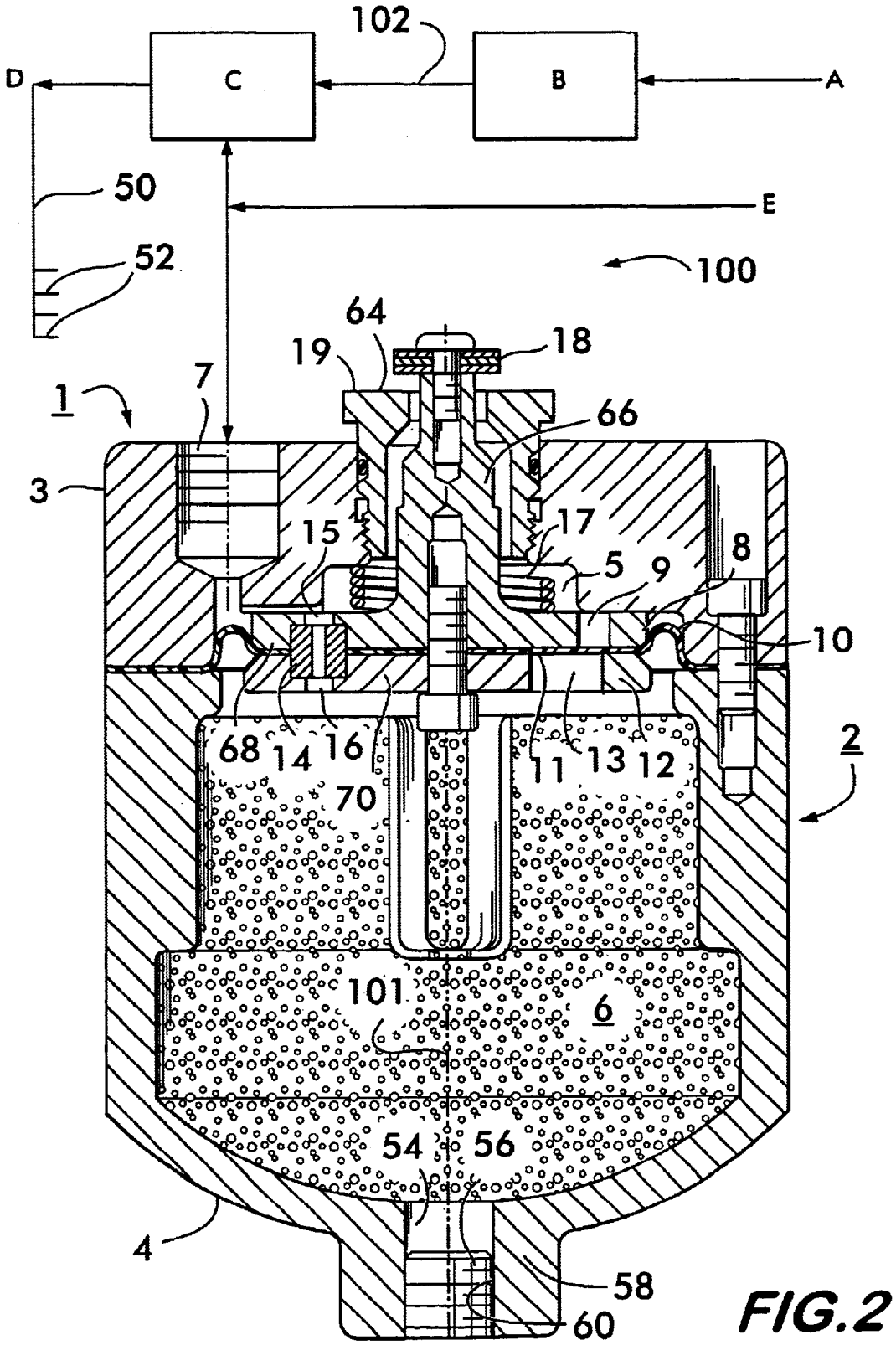
FIG. 2 is a cross-sectional view of a dry accelerator for a dry sprinkler system according to the present invention, shown in the open position.

Referring now to FIG. 2, which shows the dry accelerator of the present invention in an actuated, open condition, when there is a sudden decay of the sprinkler system air pressure, such as is caused by actuation of one of the sprinkler heads, the gas pressure in the upper gas compartment 5 of the dry accelerator 1 simultaneously falls as gas flows from the upper gas compartment 5 back through the gas orifice 7. As the gas pressure in the upper gas compartment 5 falls, the diaphragm 10 seals against the base of accelerator shaft 8. Gas pressure in the lower gas compartment 6 is prevented from falling by the restrictor 14, which is in fluid communication between the lower gas compartment 6 and the upper gas compartment 5. Gas flows from the lower gas compartment 6 through restrictor 14 at a slower rate than from the upper gas compartment 5. Before the gas pressure in the upper gas compartment 5 decays by approximately 5 psi, the gas pressure in the lower gas compartment 6 creates a differential force acting on the piston 12 in the accelerator shaft 8, sufficient to overcome a closing force caused by spring 17, that urges the upper seal 18 to move away from the adjusting nut 19, thereby exhausting the upper gas compartment 5 to atmosphere. Gas exiting from the upper gas compartment 5 to atmosphere simultaneously causes gas to exhaust from the sprinkler control valve actuator C, causing the actuator C to operate in its intended manner to open an extinguishing liquid line 102, running from the pressurized liquid source (A) through the sprinkler control valve (B), thereby causing the sprinkler control valve to actuate and allow extinguishing liquid to enter the sprinkler system and flow through piping 50 to the individual sprinkler heads 52.

While the present invention has been disclosed with reference to specific embodiments and particulars thereof, many variations thereof will be apparent to those skilled in the art. Accordingly, it is intended that the scope of the invention be determined by the following claims.

What is claimed is:

1. An accelerator for venting a pressurized gas source to the ambient, said accelerator comprising:

a first gas compartment having an inlet orifice connectable to said pressurized gas source and an outlet providing fluid communication with the ambient;

a second gas compartment positioned adjacent to said first gas compartment and having a closable opening providing fluid communication with the ambient;

a flexible diaphragm positioned between said first and said second gas compartments, said diaphragm being deflectable in response to relative gas pressure within said compartments;

a one-way valve positioned in said diaphragm allowing gas to pass from said first gas compartment to said second gas compartment;

a restrictor orifice positioned in said diaphragm allowing gas to pass between said first and said second gas compartments at a predetermined rate; and a valve member attached to said diaphragm and extending to a position engaging said outlet, said valve member being movable upon deflection of said diaphragm between a closed position closing said outlet and an open position opening said outlet to the ambient, said valve member being normally in said closed position and moving to said open position upon deflection of said diaphragm toward said first gas compartment in response to a pressure drop of said pressurized gas source of a predetermined magnitude, thereby venting said pressurized gas source to the ambient through said outlet.

2. An accelerator according to claim 1, further comprising a spring engaging and biasing said valve member into said closed position with a predetermined biasing force.

3. An accelerator according to claim 2, further comprising a valve seat surrounding said outlet, said valve member comprising:

an elongated piston having an end distal to said diaphragm and extending outwardly of said first gas compartment through said outlet;

a sealing member positioned on said end of said piston sealingly engageable with said valve seat to open and close said outlet; and said spring being positioned within said first gas compartment between said diaphragm and said outlet and biasing said sealing member into engagement with said valve seat thereby closing said outlet, said sealing member being movable out of engagement with said seat when gas pressure within said second gas compartment exerts a force on said diaphragm exceeding the force exerted by gas pressure within said first gas compartment and said predetermined biasing force of said spring.

4. An accelerator according to claim 3, further comprising an adjusting nut surrounding said outlet and threadably engaging said upper chamber, rotation of said adjusting nut effecting movement of said piston relatively to said outlet for compressing and de-compressing said spring and thereby adjusting said predetermined biasing force.

5. An accelerator according to claim 1, wherein said closable opening comprises a removable plug sealingly engaging said opening, removal of said plug venting said second gas compartment to the ambient and allowing gas pressure within said first gas compartment to deflect said diaphragm and move said valve member from said open to said closed position thereby effecting a resetting of said accelerator.

6. An accelerator according to claim 5, wherein said closable opening comprises a threaded nipple extending outwardly from said second gas compartment, said plug having threads engageable with said nipple.

7. An accelerator according to claim 1, wherein said valve member comprises:

a piston positioned within said first gas compartment and extending into said outlet;

a flange extending radially outwardly from said piston and engaging said diaphragm; and a retainer plate positioned within said second gas compartment and attached to said piston, said diaphragm being sandwiched between said flange and said retainer plate.

8. An accelerator according to claim 7, wherein said one way valve comprises:

a first aperture extending through said flange and positioned so as to be covered by said diaphragm;

a second aperture extending through said diaphragm and located in a position offset from said first aperture; and a third aperture extending through said retainer plate, said third aperture being sized and positioned so as to overlie both said first and second apertures, relatively higher gas pressure within said first gas compartment acting through said first aperture and deflecting said diaphragm into said third aperture thereby uncovering said first aperture and allowing gas to pass from said first compartment through said first, second and third apertures and into said second gas compartment, and relatively higher gas pressure in said second compartment acting through said third aperture and forcing said diaphragm against said flange and thereby covering said first aperture and preventing gas from passing from said second to said first gas compartment.

9. An accelerator according to claim 8, wherein said diaphragm comprises a polymer material.

10. In a fire suppression sprinkler system having piping connected to a plurality of sprinkler heads in fluid communication with a source of pressurized water through a control valve actuated by an actuator connected with a pressurized gas source, an accelerator operatively associated with said actuator and connected with said pressurized gas source, said accelerator causing the actuator to open said control valve in response to a decrease in pressure of said pressurized gas source, said accelerator comprising:

a first gas compartment having an inlet orifice connected to said pressurized gas source and an outlet providing fluid communication with the ambient;

a second gas compartment positioned adjacent to said first gas compartment and having a closable opening providing fluid communication with the ambient;

a flexible diaphragm positioned between said first and said second gas compartments, said diaphragm being deflectable in response to relative gas pressure within said compartments;

a one-way valve cooperating with said diaphragm allowing gas to pass from said first gas compartment to said second gas compartment;

a restrictor orifice positioned in said diaphragm allowing gas to pass between said first and said second gas compartments at a predetermined rate; and a valve member attached to said diaphragm and extending to a position engaging said outlet, said valve member being movable upon deflection of said diaphragm between a closed position closing said outlet and an open position opening said outlet to the ambient, said valve member being normally in said closed position and moving to said open position upon deflection of said diaphragm toward said first gas, compartment in response to said decrease in pressure of said pressurized gas source of a predetermined magnitude, thereby venting said pressurized gas source to the ambient through said outlet and causing said actuator to actuate said control valve, thereby providing water from said pressurized water source to said piping and said sprinkler heads.

11. A fire suppression sprinkler system according to claim 10, wherein said source of pressurized gas comprises gas at a predetermined pressure trapped in said piping, said decrease in gas pressure within said piping occurring when at least one of said sprinkler heads opens in response to heat from a fire.

* * * * *